US009493028B2

(12) United States Patent
Kubota et al.

(10) Patent No.: US 9,493,028 B2
(45) Date of Patent: Nov. 15, 2016

(54) ROTATING-OPERATION TYPE OF WRITING TOOL

(71) Applicant: Kabushiki Kaisha Pilot Corporation, Chuo-Ku, Tokyo-To (JP)

(72) Inventors: Masaaki Kubota, Hiratsuka (JP); Takashi Iwahara, Hiratsuka (JP)

(73) Assignee: KABUSHIKI KAISHA PILOT CORPORATION, Tokyo-To (JP)

( * ) Notice: Subject to any disclaimer, the term of this patent is extended or adjusted under 35 U.S.C. 154(b) by 0 days.

(21) Appl. No.: 14/430,873

(22) PCT Filed: Sep. 20, 2013

(86) PCT No.: PCT/JP2013/075423

§ 371 (c)(1),
(2) Date: Mar. 24, 2015

(87) PCT Pub. No.: WO2014/046227

PCT Pub. Date: Mar. 27, 2014

(65) Prior Publication Data

US 2015/0290963 A1 Oct. 15, 2015

(30) Foreign Application Priority Data

Sep. 24, 2012 (JP) ..... 2012-210018

(51) Int. Cl.
*B43K 24/02* (2006.01)
*B43K 5/16* (2006.01)
(Continued)

(52) U.S. Cl.
CPC ..... *B43K 24/06* (2013.01); *B43K 5/16* (2013.01); *B43K 5/17* (2013.01); *B43K 7/12* (2013.01); *B43K 8/24* (2013.01)

(58) Field of Classification Search
CPC ..... B43K 24/06; B43K 5/16; B43K 5/17; B43K 7/12; B43K 8/24
USPC ..... 401/116, 108
See application file for complete search history.

(56) References Cited

U.S. PATENT DOCUMENTS 2,693,171 A 11/1954 Lanoie
5,121,140 A 6/1992 Fukumura
(Continued)

FOREIGN PATENT DOCUMENTS

CH 257750 A 10/1948
CN 101010207 A 8/2007
(Continued)

OTHER PUBLICATIONS

Chinese Office Action issued on Nov. 27, 2015 with English Translation, Chinese Patent Application No. 201380049734.2.
(Continued)

*Primary Examiner* — Jennifer C Chiang
(74) *Attorney, Agent, or Firm* — Perkins Coie LLP

(57) ABSTRACT

A rotating-operation type of writing tool is provided in which a front axial cylinder and a rear axial cylinder are separable and a tip portion of the writing tool is caused to protrude from a front portion of the front axial cylinder by a rotating operation of the rear axial cylinder. When the rear axial cylinder (3) is rotated, the cam cylinder (17) is also rotated, thereby the cam protrusion (18*a*) moves forward due to the functions of the cam groove (17*a*) and the slit (18*b*), so that the slider (18) moves forward to cause the writing body (14) to move forward against a biasing force by the biasing member (15). The slider (18) has the hollow body (18*m*), the coil spring (18*c*) and the flange body (18*f*). The O-ring (19) is provided on the outer circumference of the flange body (18*f*).

4 Claims, 10 Drawing Sheets

(51) Int. Cl.

| | |
|---|---|
| ***B43K 24/06*** | (2006.01) |
| ***B43K 8/24*** | (2006.01) |
| ***B43K 7/12*** | (2006.01) |
| ***B43K 5/17*** | (2006.01) |

(56) References Cited

U.S. PATENT DOCUMENTS

| | | | | |
|---|---|---|---|---|
| 7,530,751 | B2 * | 5/2009 | Journe | B43K 5/17 401/107 |
| 8,117,447 | B2 * | 2/2012 | Leu | H04N 7/17318 709/203 |
| 8,128,301 | B2 * | 3/2012 | Rolion | B43K 7/12 401/116 |
| 8,348,536 | B2 * | 1/2013 | Yoon | B43K 8/003 401/108 |
| 2014/0241783 | A1 * | 8/2014 | Niemeyer | B43K 24/06 401/232 |

FOREIGN PATENT DOCUMENTS

| | | | |
|---|---|---|---|
| DE | 3438074 | A1 | 4/1986 |
| FR | 1438554 | A | 5/1966 |
| GB | 685706 | A | 1/1953 |
| JP | H07214972 | A | 8/1995 |
| JP | 2007-237394 | | 9/1995 |
| JP | 2007-320209 | | 12/2007 |
| JP | 320209 | A | 12/2007 |

OTHER PUBLICATIONS

International Application No. PCT/JP2013/075423; International Search Report mailed Nov. 12, 2013; 2 pages; ISA/JPO.

Supplemental European Search Report in European Application No. 13838869.9, mailing date May 6, 2016, 5 pages.

* cited by examiner

ROTATING-OPERATION TYPE OF WRITING TOOL

This application is a U.S. National Stage Application of PCT/02013/075423 filed Sep. 20, 2013, which claims priority to Japanese Patent Application No. 2012-210018 filed Sep. 24, 2012. The entire contents of the above-identified applications are hereby incorporated by reference.

TECHNICAL FIELD

The present invention relates to a rotating-operation type of writing tool in which a front axial cylinder and a rear axial cylinder are separable and a tip portion of the writing tool is caused to protrude from a front portion of the front axial cylinder by a rotating operation of the rear axial cylinder.

BACKGROUND ART

Various kinds of rotating-operation types of writing tools have been conventionally known in which a front axial cylinder and a rear axial cylinder are separable and a tip portion of the writing tool is caused to protrude from a front portion of the front axial cylinder by a rotating operation of the rear axial cylinder. For example, JP 2007-320209 by the same applicant has disclosed an example of a rotating-operation type of writing tool in detail.

FIG. 9 is a sectional view of the rotating-operation type of writing tool disclosed in JP 2007-320209. This writing tool is a fountain pen 101 in which a tail crown 103 is arranged at a rear portion of a cylindrical body 102, and the cylindrical body 102 and the tail crown 103 form an entire cylinder 104. The cylindrical body 102 is formed by a front inner cylinder 105 and a rear inner cylinder, which are respectively covered (overlapped) by a front axial member 107 and a rear axial member 108, wherein the front inner cylinder 105 and the rear inner cylinder 106 are jointed to each other by a male screw portion 105*a* and a female threaded portion being threadably mounted on each other.

A hollow pipe 109 is mounted at a front portion of the front inner cylinder 105 of the cylindrical body 102. An elastic front-end member 110, which is made of a rubber, is mounted at a front portion of the hollow pipe 109. A lid 112 is arranged at an inclined front-end surface of the elastic front-end member 110 in such a manner that the lid 112 is closed by a snapping force of a torsion coil spring 111.

A coil portion 111*a* of the torsion coil spring 111 is pierced through by an axial rod 113 mounted on the hollow pipe 109. The axial rod 113 also pierces through winding-back portions 112, which are arranged at a lower end of the lid 112 so as to sandwich both sides of the coil portion 111*a*. Thus, the lid 112 can be opened and closed around the axial rod 113 serving as a fulcrum.

In addition, a bending-back portion 111*b* formed on a front-end side of the torsion coil spring 111 is engaged on an engaging portion 112*b* formed by bending an upper portion of the lid 112, and a rear arm portion 111*c* of the torsion coil spring 111 abuts on a side surface of the hollow pipe 109. Thus, the torsion coil spring 111 always biases the lid 112 toward the elastic front-end member 110.

A writing body 114, which has a structure of a fountain pen, is arranged in the cylindrical body 102. The writing body 114 has a pen body as a writing tip 114*b* at a front portion of a writing body base 114*a*, and an ink cartridge 114*c* containing ink for a fountain pen at a rear portion of the writing body base 114*a*.

A coil spring 115 is arranged between a step 114*d* formed at an intermediate portion of the writing body base 114*a* and a rear end portion 109*a* of the hollow pipe 109. The coil spring 115 has a function to always bias the writing body 114 rearward. A guide protrusion 114*e* provided on the writing body base 114*a* is loosely fitted (slidably fitted) into a slide groove 105*b* formed on an inside surface of the front inner cylinder 105. Thus, the writing body 114 can move forward and rearward without any rotation.

A female threaded portion 116*a* of a tail-crown inner cylinder 116 is threadably mounted on a male screw portion 106*b* formed at a rear end of the rear inner cylinder 106.

A cam cylinder 117 having a spiral cam groove 117*a* is arranged in the tail-crown inner cylinder 116. A male screw portion 117*b* of the cam cylinder 117 is threadably mounted on a female threaded portion 103*a* of the tail crown 103, thereby the cam cylinder 117 is rotatable integrally with the tail crown 103.

A pushing member 118 is arranged in the cam cylinder 117. A cam protrusion 118*a* having a shape like a head portion of a protruding pin is provided on a side surface of the pushing member 118. The cam protrusion 118*a* is loosely fitted in the cam groove 117*a*, and also loosely fitted in a slit 116*b* formed on the tail-crown inner cylinder 116 in a longitudinal direction thereof. In the example shown in FIG. 9, two pairs of the cam groove 117*a* and the slit 116*b* are provided axisymmetrically, and two cam protrusions 118*a* are provided correspondingly to them.

A flange 118*b*, whose diameter is larger, is provided at a front-end portion of the pushing member 118. A rear end of the ink cartridge 114*c* of the writing body 114 is caused to abut on the flange 118*b*. The coil spring 115 always biases the pushing member 118 rearward via the writing body 114, so that an O-ring 119 made of a rubber and mounted on a rear portion of the flange 118*b* is caused to abut on a jaw portion 106*c* formed on an inner surface of the rear inner cylinder 106. Thus, as shown in FIG. 9, under a situation in which the writing tip 114*b* has been caused to withdraw into the cylindrical body 102, the lid 112 abuts on the elastic front-end member 110 so that the front portion of the cylindrical body 102 assures airtightness, and the O-ring 119 abuts on the jaw portion 106*c* so that the rear portion of the cylindrical body 102 assures airtightness. Thus, as a result, the inside space of the cylindrical body 102 is closed sealingly.

Next, FIG. 10 shows a situation in which the writing tip 114*b* has been caused to protrude from the cylindrical body 102*a*.

When the tail crown 103 is rotated in a clockwise direction (in a direction shown by an arrow in FIG. 10), the cam cylinder 117 is also rotated in the clockwise direction integrally, which creates a force to rotate in the clockwise direction the cam protrusion 118*a* loosely fitted into the cam groove 117*a* of the cam cylinder 117. Herein, the cam protrusion 118*a* is also loosely fitted into the slit 116*b* of the tail-crown inner cylinder 116. Therefore, the cam protrusion 118*a* cannot be rotated in the clockwise direction. Instead, the cam protrusion 118*a* is slidably moved forward in the spiral cam groove 117*a* while being guided by the slit 116*b*.

Accordingly, the pushing member 118 is caused to move forward together with the cam protrusion 118*a*, so that the writing body 114 abutting on the pushing member 118 is also caused to move forward while compressing the coil spring 115. Subsequently, the writing tip 114*b* opens the lid 112, and the writing tip 114*b* protrudes from a front-end opening 107*a* formed at a front end portion of the front axial member 107.

After the writing tip 114*b* has protruded from the front-end opening 107*a*, the cam protrusion 118*a* of the pushing member 118 is held in a holding groove 117*c* provided adjacently to the cam groove 117*a*. Thus, the protruding condition of the writing tip 114*b* is maintained. The holding groove 117*c* is formed in a manner to go back a little in the axial direction of the cam cylinder 117 from the front end of the spiral cam groove 117*a*. Thereby, when the cam protrusion 118*a* is biased rearward in the holding groove 117*c* by the coil spring 115, the cam protrusion 118*a* is caught.

When the tail crown 103 is rotated in the opposite direction (anticlockwise direction) from the situation shown in FIG. 10, the cam protrusion 118*a* of the pushing member 118 is released from the holding groove 117*c* of the cam cylinder 117. Subsequently, by means of the elastic force of the coil spring 115, the cam protrusion 118*a* is subjected to a force in a direction opposite to that when the cam protrusion 118*a* has moved forward. Thus, the cam protrusion 118*a* moves rearward in the cam groove 117*a* while giving an opposite rotating force to the cam groove 117*a*. The pushing member 118 also moves rearward, and thus the writing body 114 that is biased by the coil spring 115 moves rearward, too. The impact that the writing body 114 may receive when the writing body 114 moves rearward is cushioned by the O-ring 119 mounted on the pushing member 118 abutting on the jaw portion 106*c* of the rear inner cylinder 106.

SUMMARY OF THE INVENTION

The rotating-operation type of writing tool based on the above described JP 2007-320209 has excellent performance, and thus a wide range of users are satisfied with the actual products thereof.

Herein, the inventor has found that, when the writing body 114 that is biased by the coil spring 115 moves rearward and the O-ring 119 abuts on the jaw portion 106*c* of the rear inner cylinder 106, the cam protrusion 118*a* is not in contact with a rear end of the cam groove 117*a* in order to maintain airtightness performance by means of the O-ring 119, so that "backlash" of the rear axial cylinder 106 with respect to the front axial cylinder 102 is generated both in the rotational direction and in the front-rear direction.

The present invention has been made in view of the above circumstances. The object of the present invention is to provide a rotating-operation type of writing tool in which the impact relaxation (cushioning) performance and the airtightness maintaining performance are improved when the writing body moves rearward.

The present invention is a rotating-operation type of writing tool in which a tip portion of the writing tool is caused to protrude from a front portion of a front axial cylinder by a rotating operation of a rear axial cylinder with respect to the front axial cylinder, including: a front axial cylinder and a rear axial cylinder which are separable from each other; a rear-axial-cylinder inner cylinder provided in the rear axial cylinder and fixed to a rear portion of the front axial cylinder, the rear-axial-cylinder inner cylinder having a slit in a longitudinal direction thereof; a cam cylinder provided in the rear-axial-cylinder inner cylinder and fixed to the rear axial cylinder, the cam cylinder having a spiral cam groove; a cam protrusion loosely fitted into the cam groove of the cam cylinder and the slit of the rear-axial-cylinder inner cylinder; a slider provided in the cam cylinder, the slider being movable in the cam cylinder integrally with the cam protrusion; and a writing body provided in the front axial cylinder, the writing body being biased rearward by a biasing member relative to the front axial cylinder; wherein the slider is also biased rearward via the writing body by the biasing member; when the rear axial cylinder is rotated, the cam cylinder is rotated, thereby the cam protrusion moves forward by means of the cam groove and the slit, so that the slider moves forward to cause the writing body to move forward against a biasing force by the biasing member; the slider is formed separately by a part integral with the cam protrusion and another part to be biased rearward via the writing body by the biasing member; a second biasing member is provided between the two parts of the slider; and an O-ring is part to be biased rearward via the writing body by the biasing member.

According to the present invention, under a situation wherein the O-ring of the slider abuts on a jaw portion, the part of the slider that is integral with the cam protrusion is biased rearward by means of the second biasing member, so that a rear portion of the cam groove is biased by the cam protrusion. As a result, "backlash" of the cam cylinder is prevented very efficiently both in the rotational direction and in the front-rear direction.

Specifically, for example, the part of the slider that is integral with the cam protrusion is a hollow body, the second biasing member is a coil spring inserted into the hollow body, and the other part of the slider that is to be biased rearward via the writing body by the biasing member is a flange body. In this case, the slider including the second biasing member can be structured in a very compact manner.

More specifically, the flange body may have a small flange portion on an abutting side against the coil spring, he small flange portion may be engaged with a long through hole provided in the hollow body so that a compressed state of the coil spring is maintained, and the small flange portion may be slidably movable within the long through hole in a direction to further compress the coil spring. In this case, the impact relaxation (cushioning) performance achieved by deformation of the coil spring can be used very effectively.

Herein, under a situation wherein the tip portion of the writing body is contained in the front portion of the front axial cylinder, it is preferable that the cam protrusion is not in contact with a rear end portion of the slit. That is to say, it is preferable that the length of the slit has a margin. In this case, it is easy to install the cam cylinder into the rear-axial-cylinder inner cylinder having the slit in such a manner that a further biasing force is given rearward.

MODE FOR CARRYING OUT THE INVENTION

One embodiment of the present invention will be explained herebelow in detail with reference to the drawings.

Figure 1:
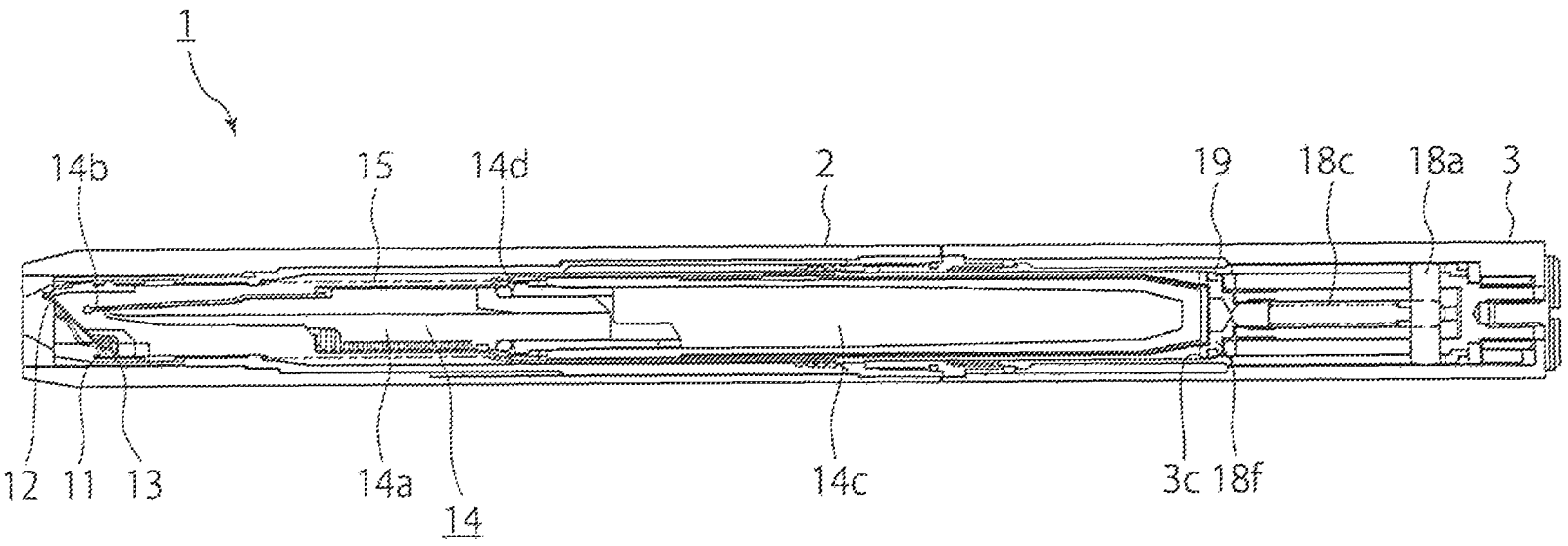
FIG. 1 is a schematic view showing a rotating-operation type of writing tool according to an embodiment of the present invention, under a situation wherein a writing body is contained.
Figure 2:
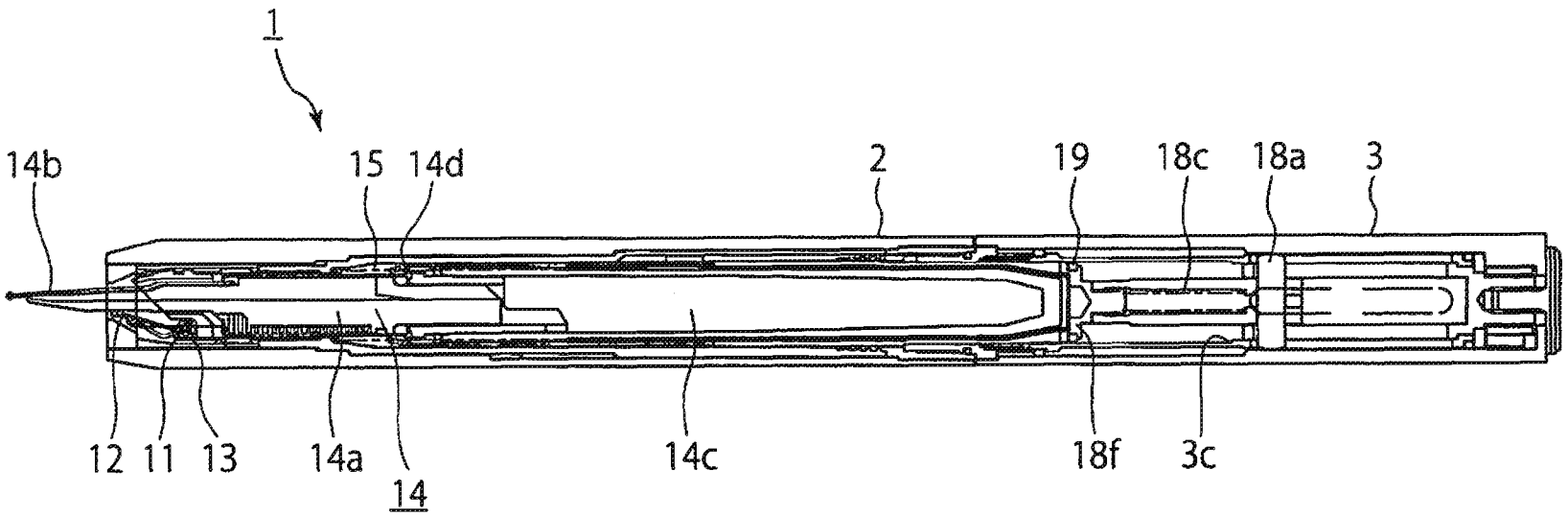
FIG. 2 is a schematic view showing the rotating-operation type of writing tool of FIG. 1, under a situation wherein the writing body is protruded.
Figure 3:
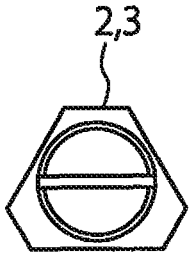
FIG. 3 is a rear view showing the rotating-operation type of writing tool of FIG. 1.

FIG. 1 is a schematic view showing a rotating-operation type of writing tool according to an embodiment of the present invention, under a situation wherein a writing body is contained. FIG. 2 is a schematic view showing the rotating-operation type of writing tool of FIG. 1, under a situation wherein the writing body is protruded. As shown in FIGS. 1 and 2, the rotating-operation type of writing tool is a fountain pen 1, which has a front axial cylinder 2 and a rear axial cylinder 3 which are separated from each other, as axial cylinders. FIG. 3 is a rear view showing the rotating-operation type of writing tool of FIG. 1. As shown in FIG. 3, the shapes of the front axial cylinder 2 and the rear axial cylinder 3 are substantially triangle-pole shapes.

As shown in FIGS. 1 and 2, a lid 12 is arranged at a front portion of the front axial cylinder 2 in such a manner that the lid 12 is closed by a snapping force of a torsion coil spring 11. A coil portion of the torsion coil spring 11 is pierced through by an axial rod 13. The lid 12 can be opened and closed around the axial rod 13 serving as a fulcrum. The torsion coil spring 11 always biases the lid 12 to a closed situation thereof.

A writing body 14, which has a structure of a fountain pen, is arranged in the front axial cylindrical 2. The writing body 14 has a pen body as a writing tip 14*b* at a front portion of a writing body base 14*a*, and an ink cartridge 14*c* containing ink for a fountain pen at a rear portion of the writing body base 14*a*.

A coil spring 15 is arranged between a step 14*d* formed at an intermediate portion of the writing body base 14*a* and the front axial cylinder 2. The coil spring 15 has a function to always bias the writing body 14 rearward. A guide protrusion (not shown) provided on the writing body base 14*a* is loosely fitted (slidably fitted) into a slide groove (not shown) formed on an inside surface of the front axial cylinder 2. Thus, the writing body 14 can move forward and rearward without any rotation.

Figure 4:
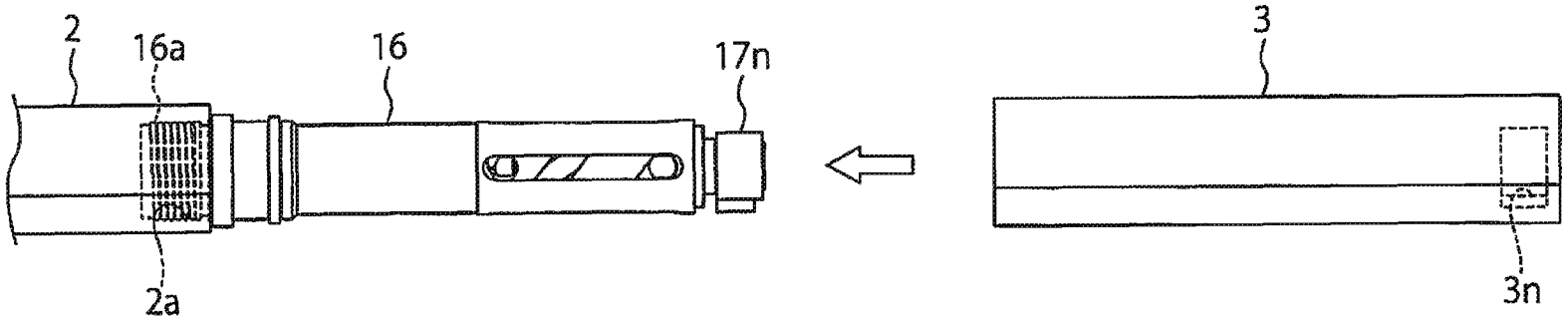
FIG. 4 is an explanatory view of an assembling step of a rear axial cylinder.
Figure 5:
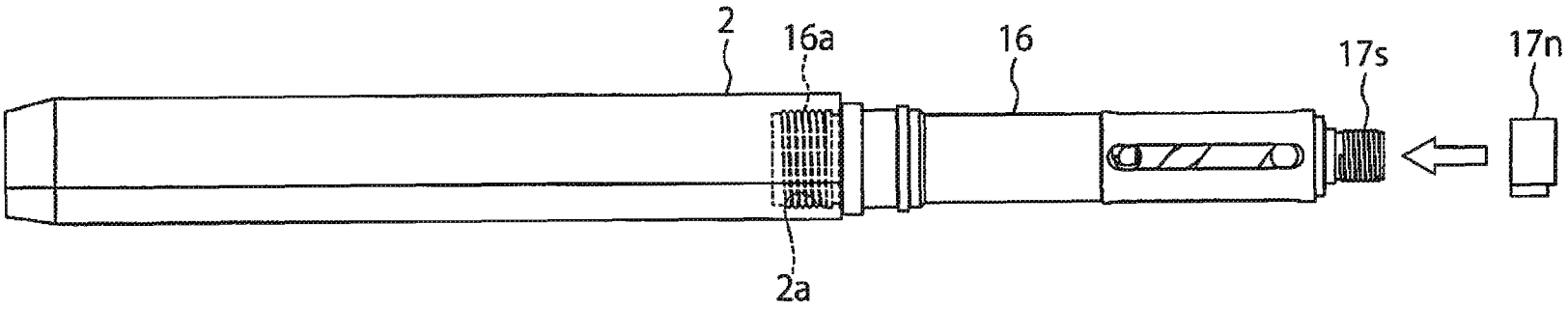
FIG. 5 is an explanatory view of an assembling step of a nut as an adjustment mechanism of rotational positions.
Figure 6:
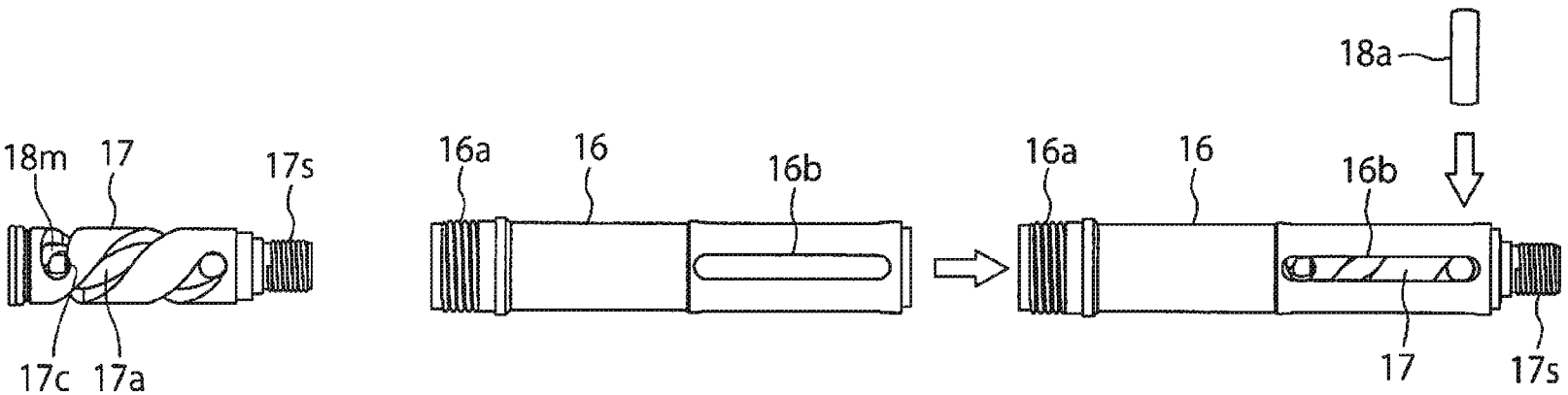
FIG. 6 is an explanatory view of an assembling step of a rear-axial-cylinder inner cylinder.
Figure 7:
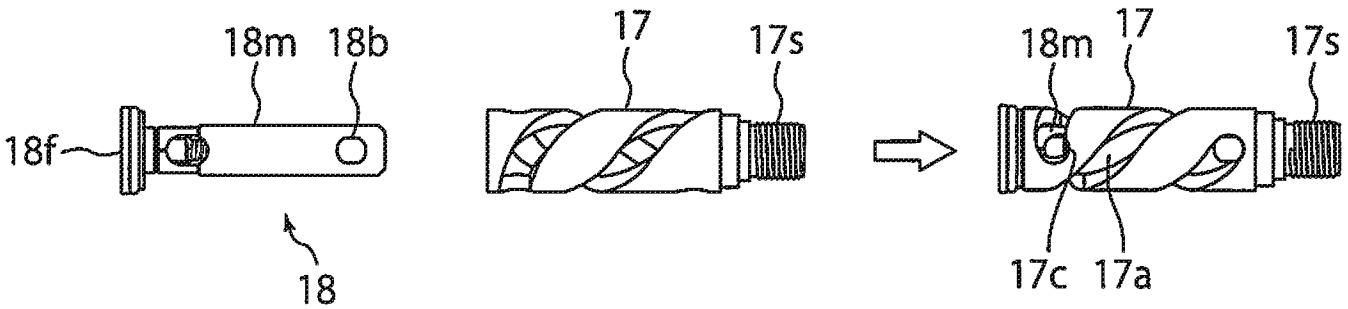
FIG. 7 is an explanatory view of an assembling step of a cam cylinder.
Figure 8:
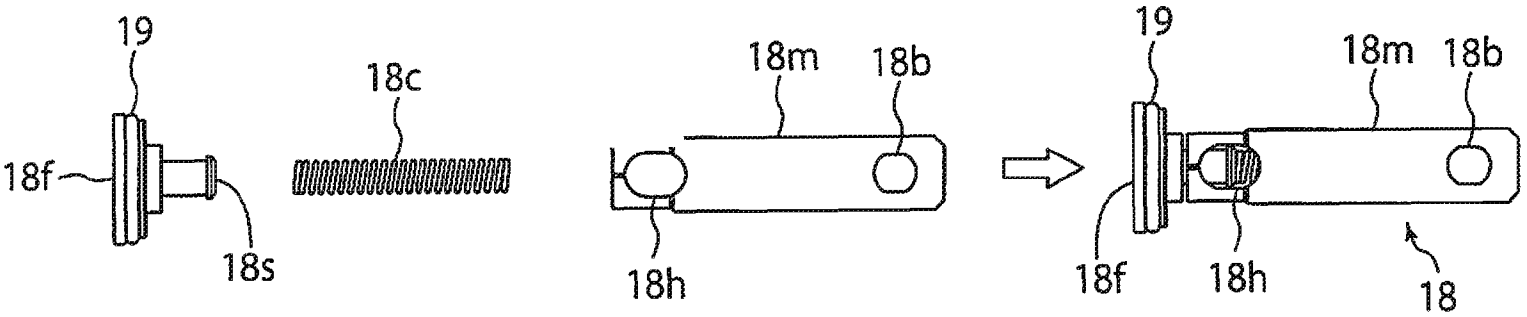
FIG. 8 is an explanatory view of an assembling step of a slider.
Figure 9:
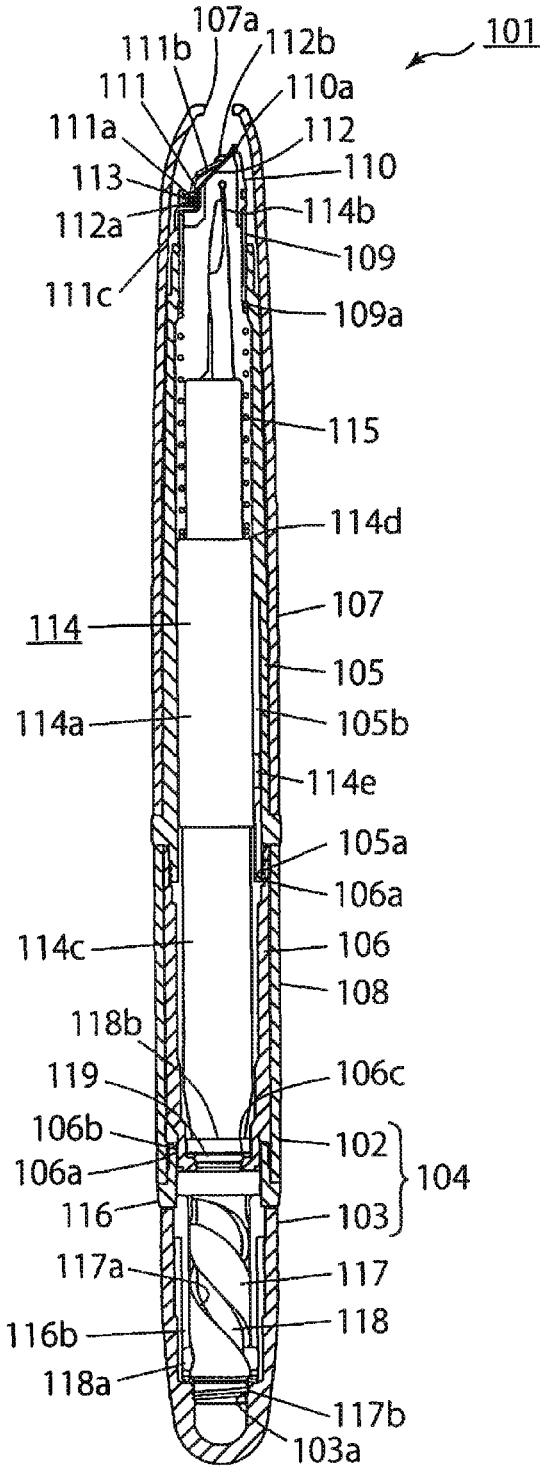
FIG. 9 (Prior art)
FIG. 9 is a schematic view showing a conventional rotating-operation type of writing tool, under a situation wherein a writing body is contained.
Figure 10:
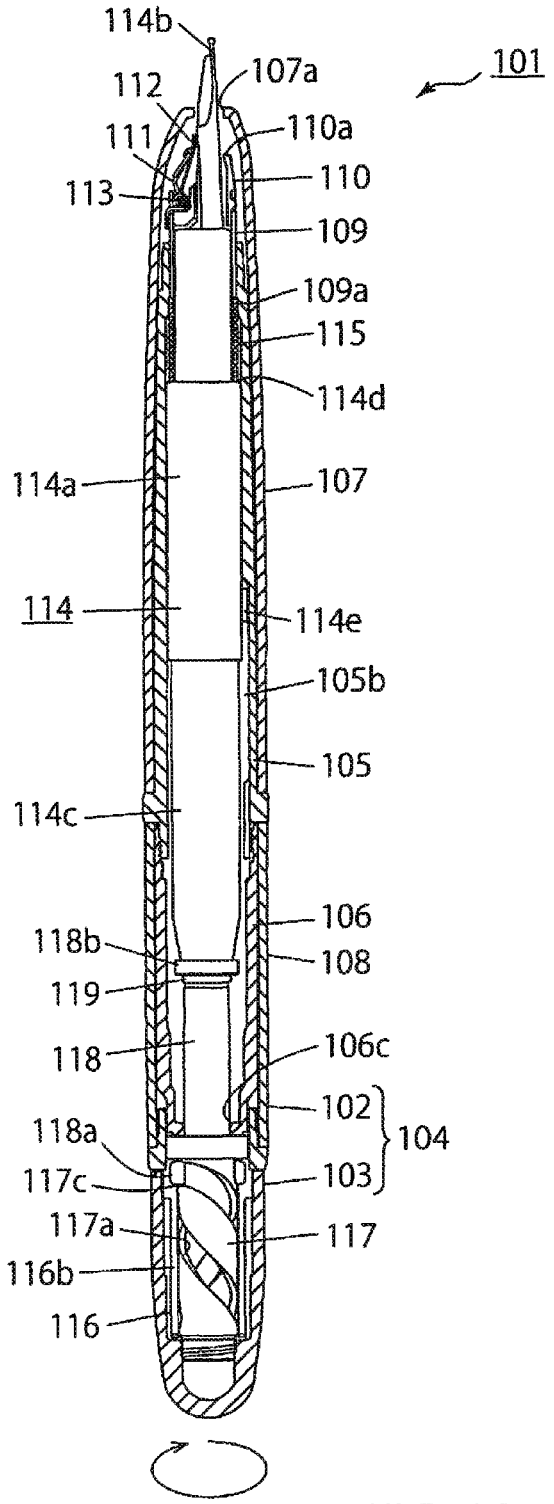
FIG. 10 (Prior art)
FIG. 10 is a schematic view showing the conventional rotating-operation type of writing tool of FIG. 9, under a situation wherein the writing body is protruded.

FIG. 4 is an explanatory view of an assembling step of the rear axial cylinder 3. FIG. 5 is an explanatory view of an assembling step of a nut 17*n* as the adjustment mechanism of rotational positions. FIG. 6 is an explanatory view of an assembling step of a rear-axial-cylinder inner cylinder 16. FIG. 7 is an explanatory view of an assembling step of a cam cylinder 17. FIG. 8 is an explanatory view of an assembling step of a slider 18.

As shown in FIG. 4, a female threaded portion 2*a* is formed at a rear end portion of the front axial cylinder 2. A male screw portion 16*a* formed at a front end portion of the rear-axial-cylinder inner cylinder 16 (see FIG. 6) is threadedly mounted on the female threaded portion 2*a* (see FIG. 5).

A cam cylinder 17 having a spiral cam groove 17*a* is arranged in the rear-axial-cylinder inner cylinder 16 (see FIG. 6). A male screw portion 17*s* of the cam cylinder 17 is fitted in a positioning portion 3*n* of the rear axial cylinder 3 (for example, a concave portion that can be fitted on the convex portion of the nut 17*n*) via the nut having a convex portion 17*n* as the adjustment mechanism of rotational positions. Thereby, the cam cylinder 17 is rotatable integrally with the rear axial cylinder 3 (see FIGS. 4, 5 and 6).

The adjustment mechanism of rotational positions in the present embodiment has the male screw portion 17*s* fixed on the cam cylinder 17, and the nut having the convex portion 17*n*, which is threadedly engaged with the male screw portion 17*s*. The nut having the convex portion 17*n* has the convex portion at a portion in the outer circumference thereof. The rotational position (rotational phase) of the convex portion of the nut having the convex portion 17*n* can be adjusted precisely as desired, by adjusting the engagement position of the nut having the convex portion 17*n* with respect to the male screw portion 17*s* (for example, by not engaging the nut having the convex portion 17*n* with a root portion of the male screw portion 17*s*). Thus, as a result, the rotational position (rotational phase) of the rear axial cylinder 3 fixed on the cam cylinder 17 and the rotational position (rotational phase) of the front axial cylinder 2 fixed on the rear-axial-cylinder inner cylinder 16 can be adjusted precisely as desired.

A hollow body 18*m*, which has a hollow cylindrical shape and one opened end, is arranged in the cam cylinder 17 (see FIGS. 7 and 8). A hole for cam protrusion 18*b*, through which a cam protrusion 18*a* (for example, an insert pin: see FIG. 6) is inserted, is provided at a side surface of the hollow body 18*m*. The cam protrusion 18*a* that has been inserted through the hole for cam protrusion 18*b* is loosely fitted in the cam groove 17*a*, and also loosely fitted in a slit 16*b* formed on the rear axial cylinder 16 in a longitudinal direction thereof. In the present embodiment, two pairs of the cam groove 17*a* and the slit 16*b* are provided axisymmetrically, and two cam protrusions 18*a* are provided correspondingly to them (both ends of the insert pin are protruded).

As shown in FIG. 8, a coil spring 18*c* is inserted in the hollow body 18*m* of the slider 18. A flange body 18*f* is provided at the opened end of the hollow body 18 in such a manner that the coil spring 18*c* is a little compressed (in such a manner that a compressing load of about 100 gf is applied to the coil spring).

Specifically, the flange body 18*f* has a small flange portion 18*s* on an abutting side against the coil spring 18*c*. The small flange portion 18*s* is engaged with a long through hole 18*h* provided in the hollow body 18*m* so that the compressed state of the coil spring 18*c* is maintained. In addition, the small flange portion 18*s* is slidably movable within the long through hole 18*h* in a direction to further compress the coil spring 18*c*.

In addition, in the situation as shown in FIG. 1 wherein the writing body is contained, the cam protrusion 18*a* is not in contact with a rear end portion of the slit 16*b*, but a little away from the rear end portion. That is to say, the length of the slit 16*b* has a margin. Thus, it is easy to set the cam cylinder 17 into the rear-axial-cylinder inner cylinder 16 having the slit 16*b* under a condition wherein a further biasing force is given rearward. In the present embodiment, the cam protrusion 18*a* is in contact with the rear end portion of the cam groove 17*a* under a condition wherein no further biasing force is given. The initial load of the coil spring 18*c* is finally adjusted to about 100 gf, under the condition wherein the further biasing force is given.

A larger flange portion is provided on the flange body 18*f* at the end opposite to the small flange portion 18*s*. A rear end of an ink cartridge 14*c* of the writing body 14 is caused to abut on the large flange portion. An O-ring 19 made of a rubber is mounted on the larger flange portion.

The coil spring 15 always biases the flange body 18*f* rearward via the writing body 14 by means of a spring force greater than 100 gf, so that the O-ring 19 made of a rubber and mounted on the large flange portion of the flange body 18*f* is caused to abut on a jaw portion 3*c* formed on an inner surface of the rear axial cylinder 3 (see FIG. 1).

Thus, as shown in FIG. 1, under a situation in which the writing tip 14*b* has been caused to withdraw into the front axial cylinder 2, the lid 12 is closed so that the front portion of the front axial cylinder 2 assures airtightness, and the O-ring 19 abuts on the jaw portion 3*c* so that the rear portion of the front axial cylinder 2 assures airtightness. Thus, as a result, the inside space of the front axial cylinder 2 is closed sealingly.

Next, FIG. 2 shows a situation in which the writing tip 14*b* has been caused to protrude from the front axial cylinder 2.

When the rear axial cylinder 3 is rotated in a clockwise direction, the cam cylinder 17 is also rotated in the clockwise direction integrally, which creates a force to rotate in the clockwise direction the cam protrusion 18*a* loosely fitted into the cam groove 17*a* of the cam cylinder 17. Herein, the cam protrusion 18*a* is also loosely fitted into the slit 16*b* of the rear-axial-cylinder inner cylinder 16. Therefore, the cam protrusion 18*a* cannot be rotated in the clockwise direction. Instead, the cam protrusion 18*a* is slidably moved forward in the spiral cam groove 17*a* while being guided by the slit 16*b*.

Accordingly, the slider 18 is caused to move forward together with the cam protrusion 18*a*, so that the writing body 14 is also caused to move forward while compressing the coil spring 15, via the coil spring 18*c* and the flange body 18*f*. Subsequently, the writing tip 14*b* opens the lid 12.

After the writing tip 14*b* has protruded, the cam protrusion 18*a* of the slider 18 is held in a holding groove 17*c* (see FIG. 6) provided adjacently to the cam groove 17*a*. Thus, the protruding condition of the writing tip 14*b* is maintained. The holding groove 17*c* is formed in a manner to go back a little in the axial direction of the cam cylinder 17 from the front end of the spiral cam groove 17*a*. Thereby, when the cam protrusion 18*a* is biased rearward in the holding groove 17*c* by the coil spring 15, the cam protrusion 18*a* is caught.

When the rear axial cylinder 3 is rotated in the opposite direction (anticlockwise direction) from the situation shown in FIG. 2, the cam protrusion 18*a* of the slider 18 is released from the holding groove 17*c* of the cam cylinder 17. Subsequently, by means of the elastic force of the coil spring 15, via the flange body 18*f* and the coil spring 18*c*, the cam protrusion 18*a* is subjected to a force in a direction opposite to that when the cam protrusion 18*a* has moved forward. Thus, the cam protrusion 18*a* moves rearward in the cam groove 17*a* while giving an opposite rotating force to the cam groove 17*a*. The slider 18 also moves rearward, and thus the writing body 14 that is biased by the coil spring 15 moves rearward, too.

According to the above embodiment, the cam cylinder 17 and the rear axial cylinder 3 are fixed via the adjustment mechanism of rotational positions, i.e., via the fitting between the nut having the convex portion 17*n* and the positioning portion 3*n* that is a concave portion corresponding to the convex portion of the nut having the convex portion 17*n*. Thus, the design of the rear axial cylinder 3 and the design of the front axial cylinder 2 can be made continuous with each other without any difference between rotational positions (rotational phases) thereof, by adjusting the rotational positions (rotational phases) of the cam cylinder 17 and the rear axial cylinder 3, even when the front axial cylinder 2 and the rear-axial-cylinder inner cylinder 16 are threadedly engaged with each other so that it is difficult to adjust their fixed rotational positions (rotational phases).

According to the above embodiment, the design of the rear axial cylinder 3 and the design of the front axial cylinder 2 can be made continuous with each other very easily without any difference between rotational positions (rotational phases) thereof. Thus, as shown in FIG. 3, it is possible to adopt outrageous shapes, for example substantially triangle-pole shapes, as shapes for the front axial cylinder 2 and the rear axial cylinder 3.

Herein, the fixing manner between the convex portion of the nut having the convex portion 17*n* and the concave portion as the positioning portion 3*n* is not limited to the above fitting manner. Any other known engagement manner can be adopted, such as a snapping connection with the use of deformable elements. In addition, oppositely in convex and concave relationship, it is possible to use a nut having a concave portion, instead of the nut having the convex portion 17*n*, i.e., it is possible to adopt such a manner that the cam cylinder 17 and the rear axial cylinder 3 are fixed via the fitting (or another engagement manner) between the nut having the concave portion and the positioning portion 3*n* that is a convex portion corresponding to the concave portion of the nut having the concave portion.

In addition, according to the present embodiment, the airtightness performance is sufficiently achieved when the writing body 14 is caused to move rearward by the biasing force of the coil spring 15 so that the O-ring 19 of the slider 18 abuts on the jaw portion 3*c*.

Furthermore, according to the present embodiment, under the situation wherein the O-ring 19 abuts on the jaw portion 3*c*, the cam protrusion 18*a* and the hollow body 18*m* of the slider 18 are biased rearward by the coil spring 18*c*. Thus, the rear portion of the cam groove 17*a* is biased by the cam protrusion 18*a*. Thus, the rear axial cylinder 3 fixed to the cam cylinder 17 is inhibited from moving both in the rotational direction and in the front-rear direction. As a result, "backlash" of the rear axial cylinder 3 with respect to the front axial cylinder 2 is prevented very efficiently both in the rotational direction and in the front-rear direction.

DESCRIPTION OF THE SIGNS

1 Fountain pen
2 Front axial cylinder
2*a* Female threaded portion
3 Rear axial cylinder
3*c* Jaw portion
3*n* Positioning portion
11 Torsion coil spring
12 Lid
13 Axial rod
14 Writing body
14*a* Writing body base
14*b* Writing tip
14*c* Ink cartridge
15 Coil spring
16 Rear-axial-cylinder inner cylinder
16*a* Male screw portion
16*b* Slit
17 Cam cylinder
17*a* Cam groove
17*n* Nut having a convex portion (adjustment mechanism of rotational positions)

17*s* Male screw portion
18 Slider
18*m* Hollow body
18*a* Cam protrusion
18*b* Hole for cam protrusion
18*c* Coil spring
18*f* Flange body
18*h* Long through hole
18*s* Small flange portion
19 O-ring

The invention claimed is:

1. A rotating-operation type of writing tool in which a tip portion of the writing tool is caused to protrude from a front portion of a front axial cylinder by a rotating operation of a rear axial cylinder with respect to the front axial cylinder, comprising:

a front axial cylinder and a rear axial cylinder which are separable from each other;

a rear-axial-cylinder inner cylinder provided in the rear axial cylinder and fixed to a rear portion of the front axial cylinder, the rear-axial-cylinder inner cylinder having a slit in a longitudinal direction thereof;

a cam cylinder provided in the rear-axial-cylinder inner cylinder and fixed to the rear axial cylinder, the cam cylinder having a spiral cam groove;

a cam protrusion loosely fitted into the cam groove of the cam cylinder and the slit of the rear-axial-cylinder inner cylinder;

a slider provided in the cam cylinder, the slider being movable in the cam cylinder integrally with the cam protrusion; and a writing body provided in the front axial cylinder, the writing body being biased rearward by a biasing member relative to the front axial cylinder;

wherein the slider is also biased rearward via the writing body by the biasing member;

when the rear axial cylinder is rotated, the cam cylinder is rotated, thereby the cam protrusion moves forward by means of the cam groove and the slit, so that the slider moves forward to cause the writing body to move forward against a biasing force by the biasing member, the slider is formed separately by a part integral with the cam protrusion and another part to be biased rearward via the writing body by the biasing member, a second biasing member is provided between the two parts of the slider, and an O-ring is part to be biased rearward via the writing body by the biasing member.

2. The rotating-operation type of writing tool according to claim 1, wherein the part of the slider that is integral with the cam protrusion is provided on an outer circumference of the a hollow body, the second biasing member is a coil spring inserted into the hollow body, and the other part of the slider that is to be biased rearward via the writing body by the biasing member is a flange body.

3. The rotating-operation type of writing tool according to claim 1, wherein the flange body has a small flange portion on an abutting side against the coil spring, the small flange portion is engaged with a long through hole provided in the hollow body so that a compressed state of the coil spring is maintained, and the small flange portion is slidably movable within the long through hole in a direction to further compress the coil spring.

4. The rotating-operation type of writing tool according to claim 1, wherein under a situation wherein the tip portion of the writing body is contained in the front portion of the front axial cylinder, the cam protrusion is not in contact with a rear end portion of the slit.

* * * * *